US007841426B2

(12) United States Patent
Zahradnik et al.

(10) Patent No.: US 7,841,426 B2
(45) Date of Patent: Nov. 30, 2010

(54) HYBRID DRILL BIT WITH FIXED CUTTERS AS THE SOLE CUTTING ELEMENTS IN THE AXIAL CENTER OF THE DRILL BIT

(75) Inventors: Anton F. Zahradnik, Sugarland, TX (US); Rolf Carl Pessier, The Woodlands, TX (US); Don Q. Nguyen, Houston, TX (US); Michael Steven Damschen, Houston, TX (US); Karlos B. Cepeda, Forth Worth, TX (US); Tim King Marvel, Churchlands (AU); Matt Meiners, Kuala Lumpur (MY)

(73) Assignee: Baker Hughes Incorporated, Houston, TX (US)

( * ) Notice: Subject to any disclaimer, the term of this patent is extended or adjusted under 35 U.S.C. 154(b) by 251 days.

(21) Appl. No.: 11/784,025

(22) Filed: Apr. 5, 2007

(65) Prior Publication Data

US 2008/0296068 A1 Dec. 4, 2008

(51) Int. Cl.
*E21B 10/14* (2006.01)

(52) U.S. Cl. ..... 175/336; 175/376; 175/431

(58) Field of Classification Search ..... 175/336, 175/376, 431

See application file for complete search history.

(56) References Cited

U.S. PATENT DOCUMENTS

| | | | |
|---|---|---|---|
| 930,759 | A | 8/1909 | Hughes |
| 1,879,127 | A | 7/1930 | Schlumpf |
| 1,874,066 | A | 8/1932 | Scott et al. |
| 1,932,487 | A | 10/1933 | Scott |
| 2,030,722 | A | 2/1936 | Scott |
| 2,198,849 | A | 4/1940 | Waxier |
| 2,216,894 | A | 10/1940 | Stancliff |
| 2,297,157 | A | 9/1942 | McClinton |
| 2,719,026 | A | 9/1955 | Boice |
| 3,010,708 | A | 11/1961 | Hlinsky et al. |
| 3,055,443 | A | 9/1962 | Edwards |
| 3,174,564 | A | 3/1965 | Morlan |
| 3,269,469 | A | 8/1966 | Kelley, Jr. |

(Continued)

FOREIGN PATENT DOCUMENTS

| | | |
|---|---|---|
| EP | 0225101 | 6/1987 |

(Continued)

OTHER PUBLICATIONS

International Search Report for corresponding International patent application No. PCT/US2008/083532.

(Continued)

*Primary Examiner*—Giovanna C Wright
(74) *Attorney, Agent, or Firm*—Locke Lord Bissell & Liddell LLP

(57) ABSTRACT

A hybrid drill bit having both roller cones and fixed blades is disclosed. The cutting elements on the fixed blades form a continuous cutting profile from the perimeter of the bit body to the axial center. The roller cone cutting elements overlap with the fixed cutting elements in the nose and shoulder sections of the cutting profile between the axial center and the perimeter. The roller cone cutting elements crush and pre-fracture formation in the weak and highly stressed nose and shoulder sections.

28 Claims, 4 Drawing Sheets

U.S. PATENT DOCUMENTS

| | | | |
|---|---|---|---|
| 3,424,258 | A | 1/1969 | Nakayama |
| RE28,625 | E | 11/1975 | Cunningham |
| 4,006,788 | A | 2/1977 | Garner |
| 4,140,189 | A | 2/1979 | Garner |
| 4,190,126 | A | 2/1980 | Kabashima |
| 4,270,812 | A | 6/1981 | Thomas |
| 4,285,409 | A | 8/1981 | Allen |
| 4,293,048 | A | 10/1981 | Kloesel, Jr. |
| 4,320,808 | A | 3/1982 | Garrett |
| 4,343,371 | A | 8/1982 | Baker, III et al. |
| 4,359,112 | A | 11/1982 | Garner et al. |
| 4,369,849 | A | 1/1983 | Parrish |
| 4,410,284 | A | 10/1983 | Herrick |
| 4,444,281 | A | 4/1984 | Schumacher, Jr. et al. |
| 4,527,637 | A | 7/1985 | Bodine |
| 4,572,306 | A | 2/1986 | Dorosz |
| 4,657,091 | A | 4/1987 | Higdon |
| 4,664,705 | A | 5/1987 | Horton et al. |
| 4,690,228 | A | 9/1987 | Voelz et al. |
| 4,726,718 | A | 2/1988 | Meskin et al. |
| 4,727,942 | A | 3/1988 | Galle et al. |
| 4,738,322 | A | 4/1988 | Hall et al. |
| 4,765,205 | A | 8/1988 | Higdon |
| 4,874,047 | A | 10/1989 | Hixon |
| 4,875,532 | A | 10/1989 | Langford, Jr. |
| 4,892,159 | A | 1/1990 | Holster |
| 4,915,181 | A | 4/1990 | Labrosse |
| 4,932,484 | A | 6/1990 | Warren et al. |
| 4,936,398 | A | 6/1990 | Auty et al. |
| 4,943,488 | A | 7/1990 | Sung et al. |
| 4,953,641 | A | 9/1990 | Pessier |
| 4,984,643 | A | 1/1991 | Isbell et al. |
| 4,991,671 | A | 2/1991 | Pearce et al. |
| 5,016,718 | A | 5/1991 | Tandberg |
| 5,027,912 | A | 7/1991 | Juergens |
| 5,028,177 | A | 7/1991 | Meskin et al. |
| 5,030,276 | A | 7/1991 | Sung et al. |
| 5,049,164 | A | 9/1991 | Horton et al. |
| 5,116,568 | A | 5/1992 | Sung et al. |
| 5,145,017 | A | 9/1992 | Holster et al. |
| 5,176,212 | A | 1/1993 | Tandberg |
| 5,224,560 | A | 7/1993 | Fernandez |
| 5,238,074 | A | 8/1993 | Tibbitts et al. |
| 5,287,936 | A | 2/1994 | Grimes et al. |
| 5,289,889 | A | 3/1994 | Gearhart et al. |
| 5,337,843 | A | 8/1994 | Torgrimsen et al. |
| 5,346,026 | A | 9/1994 | Pessier et al. |
| 5,429,200 | A | 7/1995 | Blackman et al. |
| 5,439,068 | A | 8/1995 | Huffstutler et al. |
| 5,452,771 | A | 9/1995 | Blackman et al. |
| 5,467,836 | A | 11/1995 | Grimes et al. |
| 5,513,715 | A | 5/1996 | Dysart |
| 5,518,077 | A | 5/1996 | Blackman et al. |
| 5,547,033 | A | 8/1996 | Campos, Jr. |
| 5,553,681 | A | 9/1996 | Huffstutler et al. |
| 5,558,170 | A | 9/1996 | Thigpen et al. |
| 5,570,750 | A | 11/1996 | Williams |
| 5,593,231 | A | 1/1997 | Ippolito |
| 5,606,895 | A | 3/1997 | Huffstutler |
| 5,624,002 | A | 4/1997 | Huffstutler |
| 5,641,029 | A | 6/1997 | Beaton et al. |
| 5,644,956 | A | 7/1997 | Blackman et al. |
| 5,655,612 | A | 8/1997 | Grimes et al. |
| D384,084 | S | 9/1997 | Huffstutler et al. |
| 5,695,018 | A | 12/1997 | Pessier et al. |
| 5,695,019 | A | 12/1997 | Shamburger, Jr. |
| 5,755,297 | A | 5/1998 | Young et al. |
| 5,862,871 | A | 1/1999 | Curlett |
| 5,868,502 | A | 2/1999 | Cariveau et al. |
| 5,873,422 | A | 2/1999 | Hansen et al. |
| 5,941,322 | A | 8/1999 | Stephenson et al. |
| 5,944,125 | A | 8/1999 | Byrd |
| 5,967,246 | A | 10/1999 | Caraway et al. |
| 5,979,576 | A | 11/1999 | Hansen et al. |
| 5,988,303 | A | 11/1999 | Arfele |
| 5,992,542 | A | 11/1999 | Rives |
| 5,996,713 | A | 12/1999 | Pessier et al. |
| 6,092,613 | A | 7/2000 | Caraway et al. |
| 6,095,265 | A | 8/2000 | Alsup |
| 6,109,375 | A | 8/2000 | Tso |
| 6,173,797 | B1 | 1/2001 | Dykstra et al. |
| 6,220,374 | B1 | 4/2001 | Crawford |
| 6,241,036 | B1 | 6/2001 | Lovato et al. |
| 6,260,635 | B1 | 7/2001 | Crawford |
| 6,279,671 | B1 | 8/2001 | Panigrahi et al. |
| 6,283,233 | B1 | 9/2001 | Lamine et al. |
| 6,296,069 | B1 | 10/2001 | Lamine et al. |
| RE37,450 | E | 11/2001 | Deken et al. |
| 6,360,831 | B1 | 3/2002 | Akesson et al. |
| 6,386,302 | B1 | 5/2002 | Beaton |
| 6,401,844 | B1 | 6/2002 | Doster et al. |
| 6,405,811 | B1 | 6/2002 | Borchardt |
| 6,408,958 | B1 | 6/2002 | Isbell et al. |
| 6,415,687 | B2 | 7/2002 | Saxman |
| 6,439,326 | B1 | 8/2002 | Huang et al. |
| 6,446,739 | B1 | 9/2002 | Richman et al. |
| 6,450,270 | B1 | 9/2002 | Saxton |
| 6,474,424 | B1 | 11/2002 | Saxman |
| 6,510,906 | B1 | 1/2003 | Richert et al. |
| 6,510,909 | B2 | 1/2003 | Portwood et al. |
| 6,527,066 | B1 | 3/2003 | Rives |
| 6,533,051 | B1 | 3/2003 | Singh et al. |
| 6,544,308 | B2 | 4/2003 | Griffin et al. |
| 6,562,462 | B2 | 5/2003 | Griffin et al. |
| 6,568,490 | B1 | 5/2003 | Tso et al. |
| 6,585,064 | B2 | 7/2003 | Griffin et al. |
| 6,589,640 | B2 | 7/2003 | Griffin et al. |
| 6,592,985 | B2 | 7/2003 | Griffin et al. |
| 6,601,661 | B2 | 8/2003 | Baker et al. |
| 6,601,662 | B2 | 8/2003 | Matthias et al. |
| 6,684,967 | B2 | 2/2004 | Mensa-Wilmot et al. |
| 6,729,418 | B2 | 5/2004 | Slaughter, Jr. et al. |
| 6,739,214 | B2 | 5/2004 | Griffin et al. |
| 6,742,607 | B2 | 6/2004 | Beaton |
| 6,749,033 | B2 | 6/2004 | Griffin et al. |
| 6,797,326 | B2 | 9/2004 | Griffin et al. |
| 6,843,333 | B2 | 1/2005 | Richert et al. |
| 6,861,098 | B2 | 3/2005 | Griffin et al. |
| 6,861,137 | B2 | 3/2005 | Hughes et al. |
| 6,878,447 | B2 | 4/2005 | Griffin et al. |
| 6,883,623 | B2 | 4/2005 | McCormick et al. |
| 6,986,395 | B2 | 1/2006 | Chen |
| 6,988,569 | B2 | 1/2006 | Lockstedt et al. |
| 7,096,978 | B2 | 8/2006 | Dykstra et al. |
| 7,111,694 | B2 | 9/2006 | Beaton |
| 7,137,460 | B2 | 11/2006 | Slaughter, Jr. et al. |
| 7,152,702 | B1 | 12/2006 | Bhome et al. |
| 7,234,550 | B2 | 6/2007 | Azar et al. |
| 7,350,568 | B2 | 4/2008 | Mandal et al. |
| 7,350,601 | B2 | 4/2008 | Belnap et al. |
| 7,360,612 | B2 | 4/2008 | Chen et al. |
| 7,377,341 | B2 | 5/2008 | Middlemiss et al. |
| 7,387,177 | B2 | 6/2008 | Zahradnik et al. |
| 7,392,862 | B2 | 7/2008 | Zahradnik et al. |
| 7,398,837 | B2 | 7/2008 | Hall et al. |
| 7,416,036 | B2 | 8/2008 | Forstner et al. |
| 7,435,478 | B2 | 10/2008 | Keshavan |
| 7,462,003 | B2 | 12/2008 | Middlemiss |
| 7,473,287 | B2 | 1/2009 | Belnap et al. |
| 7,493,973 | B2 | 2/2009 | Keshavan et al. |
| 7,517,589 | B2 | 4/2009 | Eyre |
| 7,533,740 | B2 | 5/2009 | Zhang et al. |
| 7,568,534 | B2 | 8/2009 | Griffin et al. |
| 2005/0087370 | A1 | 4/2005 | Ledgerwood, III et al. |

| | | | | |
|---|---|---|---|---|
| 2005/0178587 | A1 | 8/2005 | Witman, IV et al. | |
| 2005/0183892 | A1* | 8/2005 | Oldham et al. | 175/402 |
| 2005/0263328 | A1 | 12/2005 | Middlemiss | |
| 2005/0273301 | A1 | 12/2005 | Huang | |
| 2006/0032674 | A1 | 2/2006 | Chen et al. | |
| 2006/0032677 | A1 | 2/2006 | Azar et al. | |
| 2006/0162969 | A1 | 7/2006 | Belnap et al. | |
| 2006/0196699 | A1 | 9/2006 | Estes et al. | |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2006/0278442 | A1 | 12/2006 | Kristensen | |
| 2006/0283640 | A1 | 12/2006 | Estes et al. | |
| 2007/0029114 | A1 | 2/2007 | Middlemiss | |
| 2007/0062736 | A1 | 3/2007 | Cariveau et al. | |
| 2007/0079994 | A1 | 4/2007 | Middlemiss | |
| 2007/0187155 | A1 | 8/2007 | Middlemiss | |
| 2008/0066970 | A1 | 3/2008 | Zahradnik et al. | |
| 2008/0264695 | A1* | 10/2008 | Zahradnik et al. | 175/336 |
| 2008/0296068 | A1 | 12/2008 | Zahradnik et al. | |
| 2009/0114454 | A1 | 5/2009 | Belnap et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0183925 | A1 | 7/2009 | Zhang et al. | |

FOREIGN PATENT DOCUMENTS

| | | | |
|---|---|---|---|
| EP | 225101 | A * | 6/1987 |
| EP | 0225101 | A2 | 6/1987 |
| EP | 0157278 | | 11/1989 |
| EP | 0391683 | | 1/1996 |
| EP | 2089187 | | 8/2009 |
| GB | 2183694 | | 6/1987 |
| WO | 8502223 | | 5/1985 |
| WO | WO 85/02223 | | 5/1985 |
| WO | 2008124572 | | 10/2008 |

OTHER PUBLICATIONS

Written Opinion for corresponding International patent application No. PCT/US2008/083532.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins-New Concepts in PCD Drilling." Industrial Diamond Review, Mar. 1992, pp. 109-114.

Williams, J. and Thompson, A. "An Analysis of the Performance of PDC Hybrid Drill Bits." SPE/IADC 16117, SPE/IADC Drilling Conference, Mar. 1987, pp. 585-594.

Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.

Smith Services. "Hole Opener—Model 6980 Hole Opener." [retrieved from the Internet on May 7, 2008 using <URL: http://www.siismithservices.com/b_products/product_page.asp?ID=589>].

Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].

Ersoy, A. and Waller, M. "Wear characteristics of PDC pin and hybrid core bits in rock drilling." Wear 188, Elsevier Science S.A., Mar. 1995, pp. 150-165.

R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.

Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.

B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.

Jung Hye Lee, International Search Report for International Patent Application No. PCT/US2009/042514, Korean Intellectual Property Office, dated Nov. 27, 2009.

Jung Hye Lee, Written Opinion for International Patent Application No. PCT/US2009/042514, Korean Intellectual Property Office, dated Nov. 27, 2009.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

International Search Report for International Patent Application No. PCT/US2009/067969, Korean Intellectual Property Office, dated May 25, 2010.

Written Opinion for International Patent Application No. PCT/US2009/067969, Korean Intellectual Property Office, dated May 25, 2010.

* cited by examiner

HYBRID DRILL BIT WITH FIXED CUTTERS AS THE SOLE CUTTING ELEMENTS IN THE AXIAL CENTER OF THE DRILL BIT

BACKGROUND OF THE INVENTION

1. Technical Field

The present invention relates in general to hybrid drill bits and, in particular, to an improved system, method, and apparatus for a hybrid drill bit having a combination of rolling cones and fixed cutter elements for cutting at a center of the drill bit.

2. Description of the Related Art

In the prior art, some drilling bits use a combination of one or more roller cones and one or more fixed blades. Some of these combination-type drill bits are referred to as hybrid drill bits. Previous designs of hybrid drill bits, such as U.S. Pat. No. 4,343,371, to Baker, III, have provided for the roller cones to do most of the formation cutting, especially in the center of the hole or bit. Other types of combination drill bits are known as "core bits," such as U.S. Pat. No. 4,006,788, to Garner. Core bits typically have truncated roller cones that do not extend to the center of the bit and are designed to remove a core sample of formation by drilling down but around a solid cylinder of the formation before being removed.

Another type of hybrid drill bit is described in U.S. Pat. No. 5,695,019, to Shamburger, Jr., wherein the roller cones extend almost entirely to the center. Fixed cutter inserts 50 (FIGS. 2 and 3) are located in the dome area 2 or "crotch" of the bit to complete the removal of the drilled formation. Still another type of hybrid bit is sometimes referred to as a "hole opener," an example of which is described in U.S. Pat. No. 6,527,066. A hole opener has a fixed threaded protuberance that extends axially beyond the roller cones for the attachment of a pilot bit that can be a roller cone or fixed cutter bit. In these latter two cases the center is cut with fixed cutter elements but the fixed cutter elements do not form a continuous, uninterrupted cutting profile from the center to the perimeter of the bit.

Although each of these drill bits is workable for certain limited applications, an improved hybrid drill bit with enhanced drilling performance would be desirable.

SUMMARY OF THE INVENTION

One embodiment of a system, method, and apparatus for a hybrid drill bit comprises both roller cones and fixed blades. Some of the fixed cutting elements on the fixed blades are located at and near the axial center of the bit body to cut formation at the axial center. The roller cone cutting elements and the fixed cutting elements combine to define a cutting profile that extends from the axial center to the radial perimeter. The fixed cutting elements form the cutting profile at the axial center and the perimeter, while the roller cone cutting elements assist the fixed cutting elements in the midsection of the cutting profile between the axial center and the perimeter.

The midsection comprises a nose section and a shoulder section. The nose and shoulder sections are known to be the most vulnerable parts of a fixed cutter bit and are subject to extreme loading and wear. The nose is the leading part of the overall profile and the shoulder must resist side loading and lateral vibrations. In one embodiment, some of the roller cone cutting elements and the fixed cutting elements are axially aligned at the nose of the bit.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
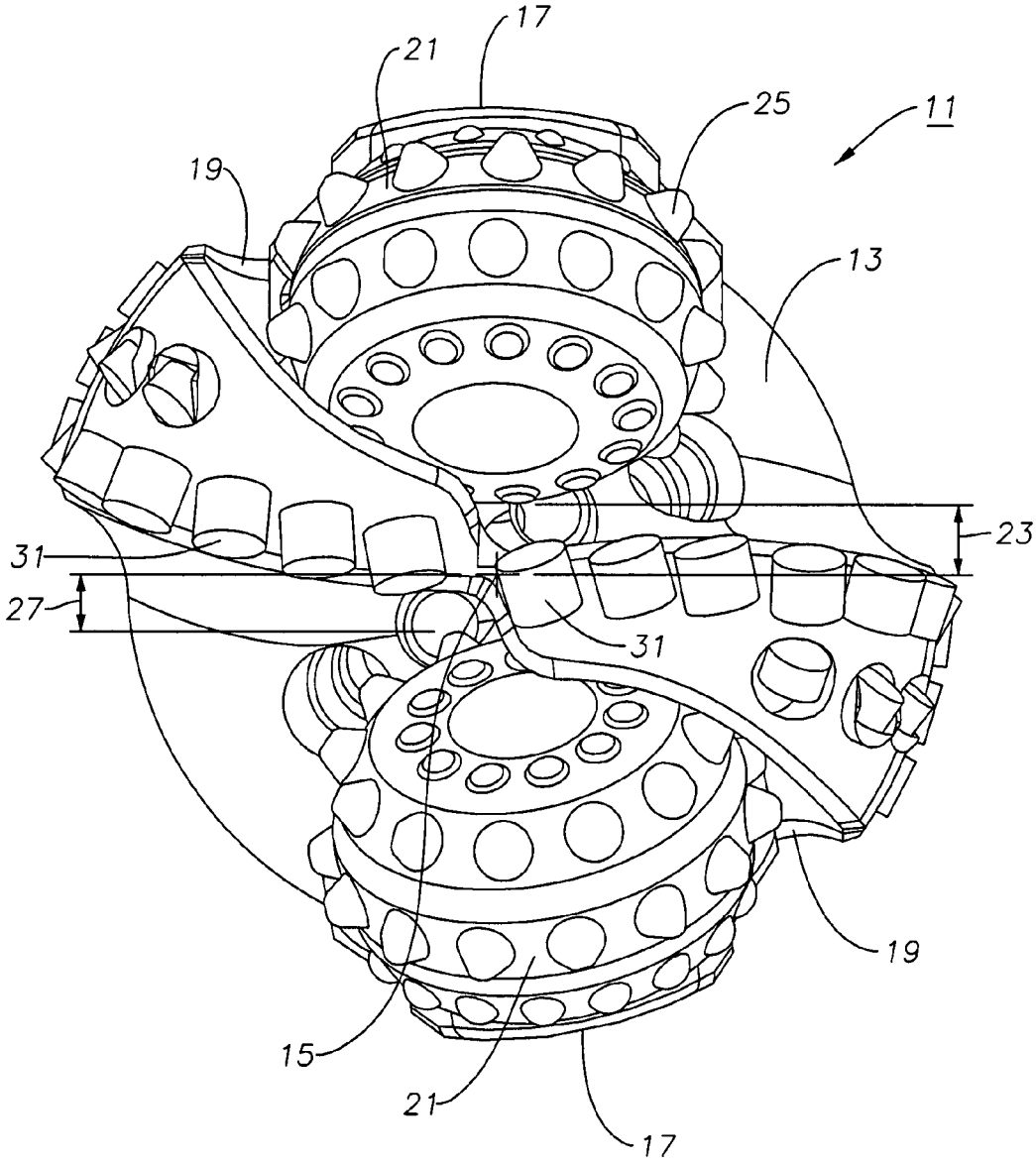
FIG. 1 is a bottom view of one embodiment of hybrid drill bit constructed in accordance with the present invention.
Figure 2:
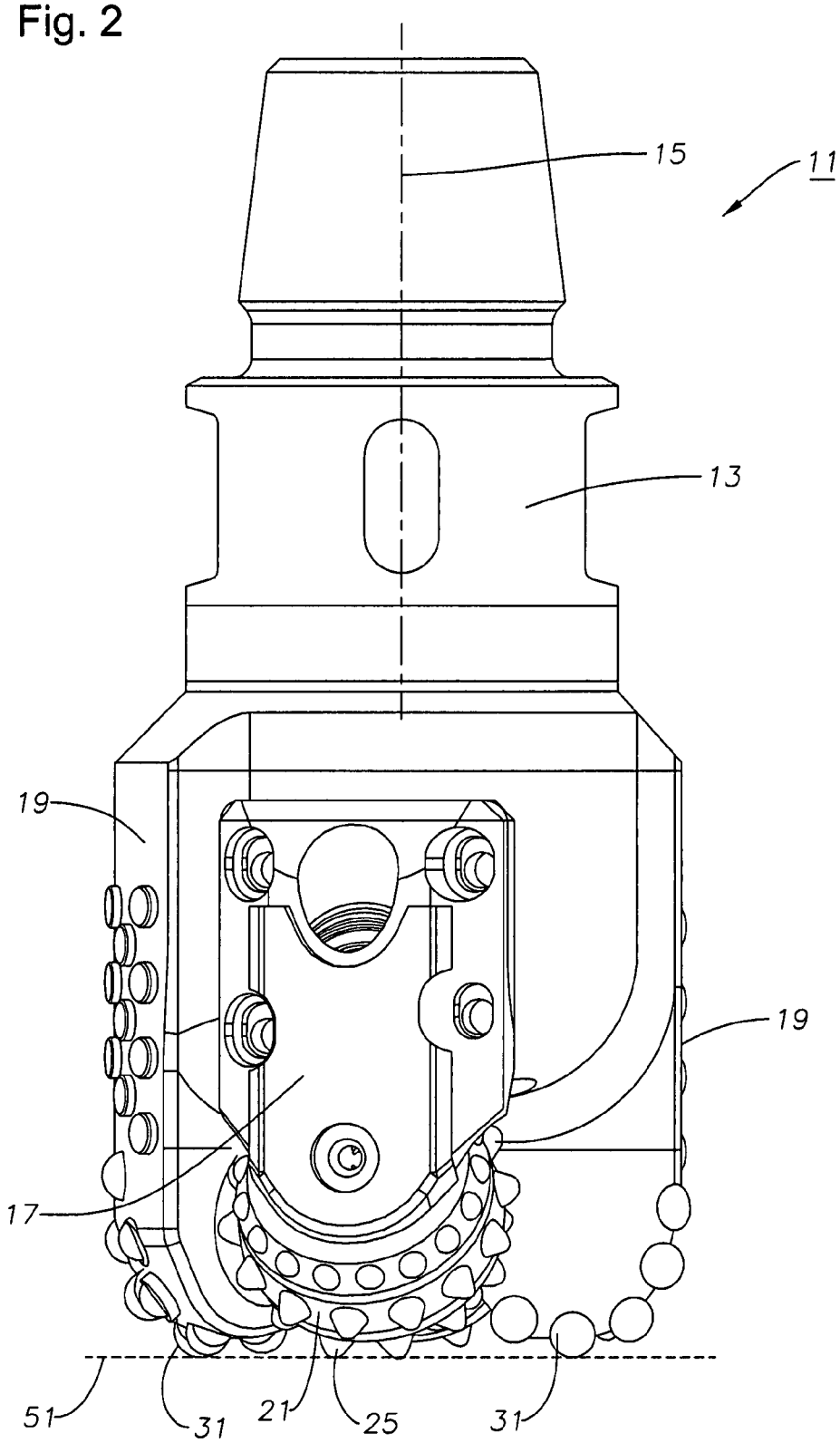
FIG. 2 is a side view of the hybrid drill bit of FIG. 1 and is constructed in accordance with the present invention.
Figure 3:
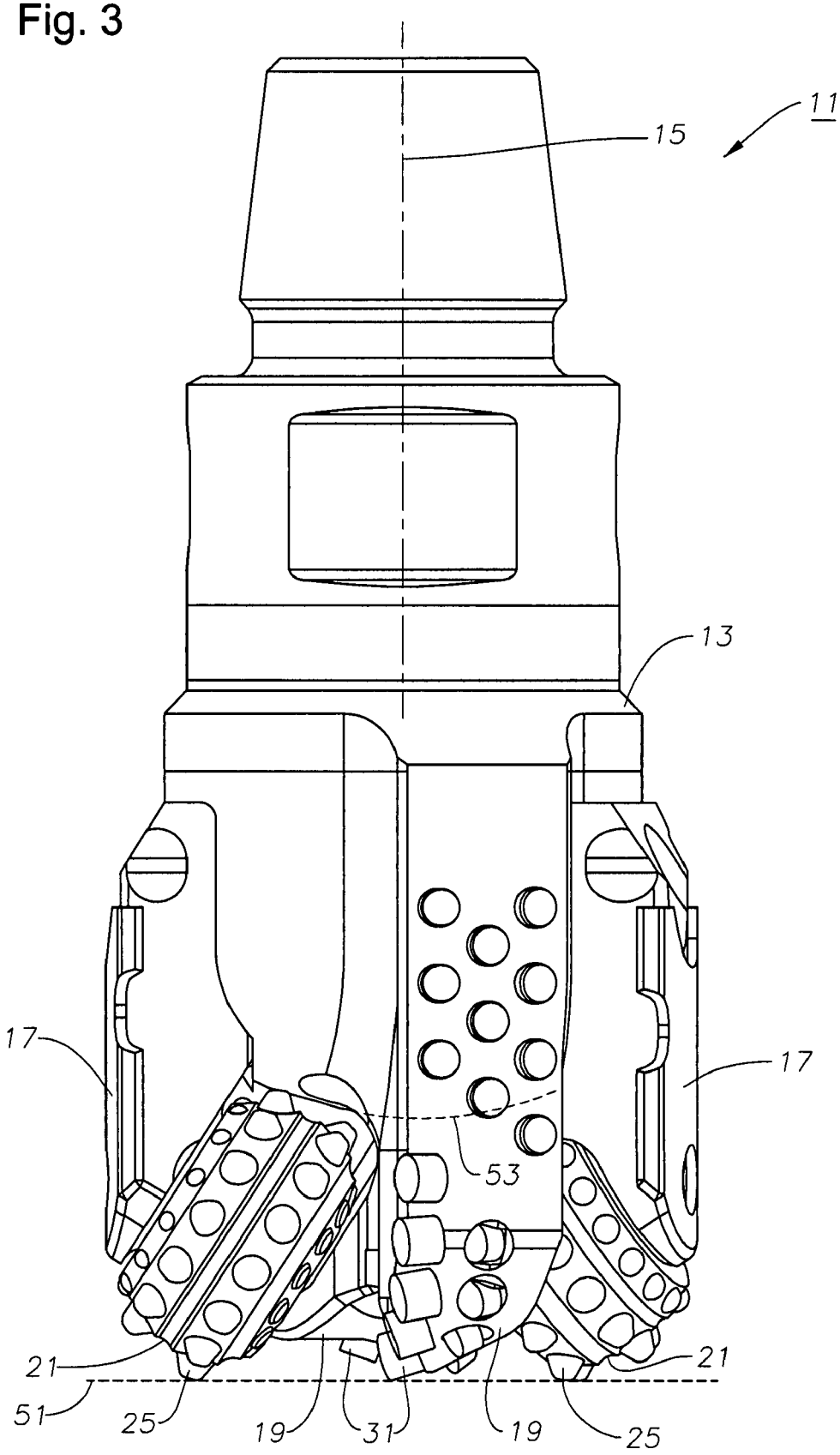
FIG. 3 is a side view of the hybrid drill bit of FIG. 1 and is constructed in accordance with the present invention.

Referring to FIGS. 1-3, one embodiment of a system, method, and apparatus for a hybrid drill bit is disclosed. The drill bit 11 comprises a bit body 13 having an axis 15 that defines an axial center of the bit body 13. A plurality (e.g., two shown) of roller cone or cutter support arms or bit legs 17 extend from the bit body 13 in the axial direction. The bit body 13 also has a plurality (e.g., also two shown) of fixed blades 19 that extend in the axial direction. The number of each of arms 17 and fixed blades 19 is at least one but may be more than two. In one embodiment, the centers of the arms 17 and fixed blades 19 are symmetrically spaced apart from each other about the axis 15 in an alternating configuration. As illustrated, each blade 19 has a leading edge that extends from the radially outermost or gage portion of the bit body 13 to the axial center 15 of the bit body 13.

Roller cones or cutters 21 are mounted to respective ones of the arms 17. Each of the roller cones or cutters 21 is truncated in length such that the distal ends of the roller cones or rolling cutters 21 are radially spaced apart from the axial center 15 (FIG. 1) by a minimal radial distance 23. A plurality of roller cone or rolling-cutter cutting inserts or elements 25 are mounted to the roller cones or rolling cutters 21 and radially spaced apart from the axial center 15 by a minimal radial distance 27. The minimal radial distances 23, 27 may vary according to the application, and may vary from cone to cone, and/or cutting element to cutting element.

In addition, a plurality of fixed cutting elements 31 are mounted to the fixed blades 19. As illustrated, fixed or fixed-blade cutting elements 31 are arranged in a row on the leading edge of each blade 19. The row extends from the radially outermost gage portion of the blade 19 and bit body 13 to or very near the axial center 15 of the bit body 13. At least one of the fixed cutting elements 31 is located at the axial center 15 of the bit body 13 and adapted to cut a formation at the axial center. In one embodiment, the innermost edge of at least one of the fixed cutting elements 31 is within approximately 0.040 inches of the axial center. Examples of roller cone cutting elements 25 and fixed cutting elements 31 include tungsten carbide inserts, cutters made of super hard material such as polycrystalline diamond, and others known to those skilled in the art.

Figure 4:
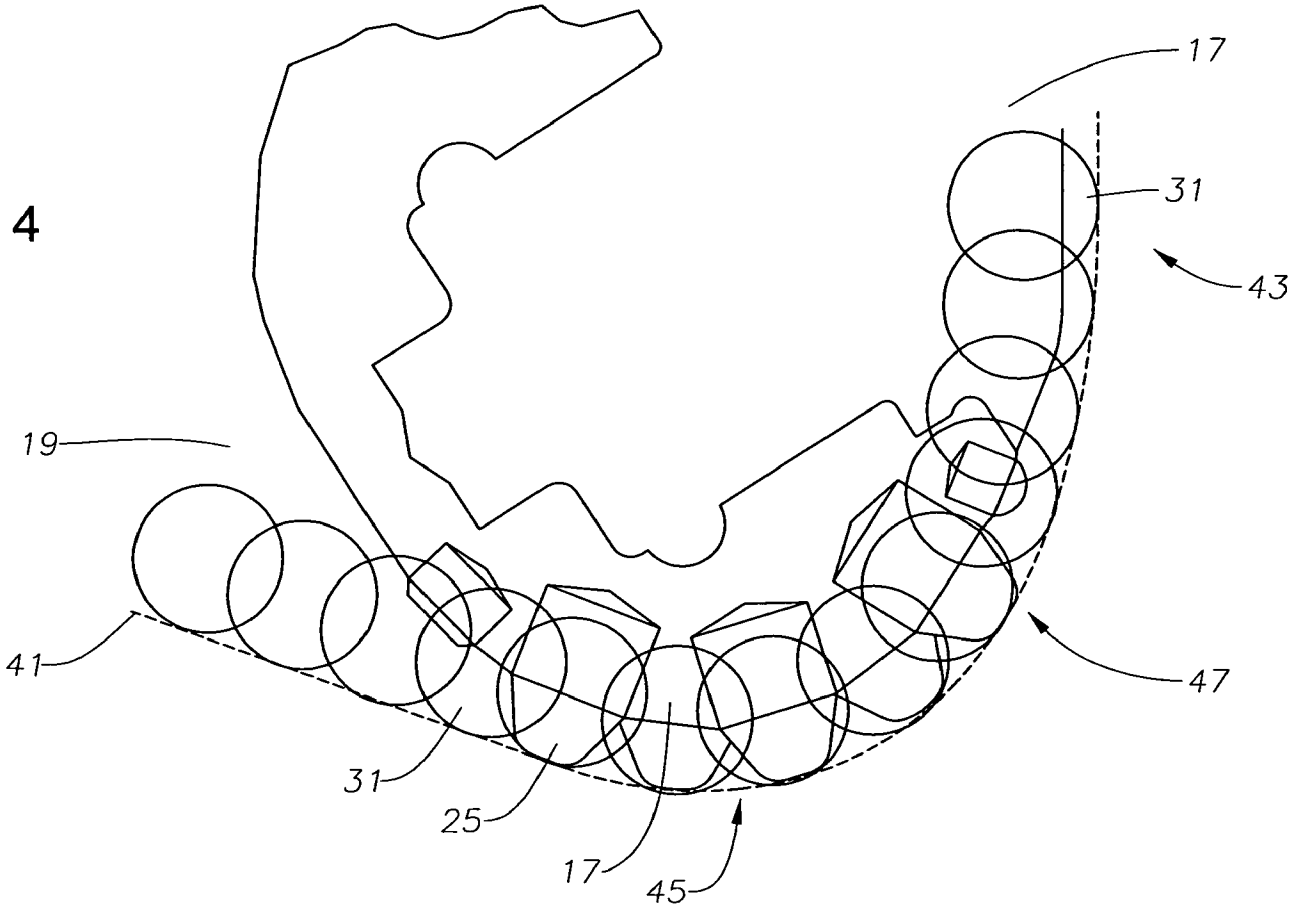
FIG. 4 is composite rotational side view of the roller cone inserts and the fixed cutting elements on the hybrid drill bit of FIG. 1 and is constructed in accordance with the present invention.

As shown in FIG. 4, the roller cone cutting elements 25 and the fixed cutting elements 31 combine to define a cutting profile 41 that extends from a cone region proximal the axial center 15 (named for the cone of formation material that forms underneath this region) to a gage region radially outermost perimeter 43 with respect to the axis. In one embodiment, only the fixed cutting elements 31 form the cutting profile 41 in the cone region at the axial center 15 and the gage or radially outermost perimeter 43. However, the roller cone cutting elements 25 overlap to produce substantially congruent surfaces or kerfs in the formation being drilled with the fixed cutting elements 31 on the cutting profile 41 between the cone region near the axial center 15 and the gage region at the radially outermost perimeter 43. The roller cone cutting elements 25 are configured to cut at the nose 45 and part of the shoulder 47 of the cutting profile 41, where the nose 45 is the axially leading part of the profile (i.e., located between the axial center 15 and the shoulder 47) facing the borehole wall and located adjacent the radially outermost perimeter 43. In this context, "shoulder" is used to describe the transition in the cutting profile between the nose region 45 and the gage region.

Thus, the roller cone cutting elements 25 and the fixed cutting elements 31 combine to define a congruent cutting face in the nose 45 and part of the shoulder 47, which are known to be the most difficult to drill parts of a fixed cutter bit profile. A reference plane 51 is located at a distal axial end of the hybrid drill bit 11, tangent to the axially distal-most portion of bit 11, as illustrated. At least one of each of the roller cone cutting elements 25 and the fixed cutting elements 31 extend in the axial direction at the reference plane 51 at a substantially equal dimension and, in the illustrated embodiment, are radially offset from each other even though they axially align. However, alternatively, the axial alignment between the distal-most elements 25, 31 is not required such that elements 25, 31 may be axially spaced apart by a selected distance when in their distal-most position.

In one embodiment, the fixed cutting elements 31 are only required to be axially spaced apart from and distal (e.g., lower than) relative to the crotch 53. In another embodiment, the roller cones 21 and roller cone cutting elements 25 may extend beyond (e.g., by approximately 0.060-inches) the distal most position of the fixed blades 19 and fixed cutting elements 31 to compensate for the difference in wear between those components. As the profile 41 transitions from the shoulder 47 to the perimeter or gage of the hybrid bit 11, the rolling cutter inserts 25 are no longer engaged (see FIG. 4), and multiple rows of vertically-staggered (i.e., axially) fixed cutting elements 31 ream out a smooth borehole wall. Rolling cone cutting elements 25 are much less efficient in reaming and would cause undesirable borehole wall damage.

The invention has several advantages and includes providing a hybrid drill bit that cuts at the center of the hole solely with fixed cutting elements and not with roller cones. The fixed cutting elements are highly efficient at cutting the center of the hole. Moreover, due to the low cutting velocity in the center, the super hard material or polycrystalline cutting elements are subject to little or no wear. The roller cones are configured to enhance the cutting action of the blades in the most difficult to drill nose and shoulder areas, which are subjected to high wear and vibration damage in harder, more abrasive formations. The crushing action of the tungsten carbide roller cone inserts drives deep fractures into the hard rock, which greatly reduces its strength. The pre- or partially fractured rock is easier to remove and causes less damage and wear to the fixed cutting elements. The perimeter or gage of the borehole is generated with multiple, vertically-staggered rows of fixed cutter inserts. This leaves a smooth borehole wall and reduces the sliding and wear on the less wear-resistant rolling cutter inserts.

While the invention has been shown or described in only some of its forms, it should be apparent to those skilled in the art that it is not so limited, but is susceptible to various changes without departing from the scope of the invention.

What is claimed is:

1. A hybrid drill bit, comprising:

a bit body having an axis, an axial center, and at least one fixed blade extending in the axial direction downwardly from the bit body;

at least one rolling cutter mounted to the bit body, the rolling cutter being truncated in length such that the distal ends of the rolling cutters are radially spaced apart from the axial center by a minimal radial distance;

at least one rolling-cutter cutting element arranged on the rolling cutter and radially spaced apart from the axial center by a minimal radial distance; and a plurality of fixed cutting elements arranged on the fixed blades wherein at least one of the fixed cutting elements is located near an axial center of the bit body and adapted to cut formation at the axial center, wherein the rolling-cutter cutting elements and the fixed cutting elements combine to define a cutting profile that extends from the axial center to a radially outermost perimeter with respect to the axis.

2. A drill bit according to claim 1, wherein the fixed cutting elements form an entirety of the cutting profile at the axial center and the radially outermost perimeter, and the rolling-cutter cutting elements overlapping the cutting profile of the fixed cutting elements between the axial center and the radially outermost perimeter.

3. A drill bit according to claim 2, wherein the rolling-cutter cutting elements cut at a nose and a shoulder portion of the cutting profile.

4. A drill bit according to claim 1, wherein the rolling-cutter cutting elements and the fixed cutting elements combine to define a cutting face at an axial end of the drill bit, and at least one of each of the rolling-cutter cutting elements and the fixed cutting elements extend in the axial direction at the cutting face at a substantially equal dimension.

5. A drill bit according to claim 1, wherein the at least one of the fixed cutting elements is within approximately 0.040 inches of the axial center.

6. A hybrid drill bit, comprising:

a bit body having an axis, an axial center, a plurality of arms extending in an axially downward direction, and a plurality of fixed blades extending in the axially downward direction;

a plurality of rolling cutters, each being mounted to a respective one of the arms, the rolling cutters being truncated in length such that the distal ends of the rolling cutters are radially spaced apart from the axial center by a minimal radial distance;

a plurality of rolling-cutter cutting elements on the rolling cutters and radially spaced apart from the axial center by a minimal radial distance;

a plurality of fixed cutting elements mounted to the fixed blades and at least one of the fixed cutting elements is located near an axial center of the bit body and adapted to cut formation at the axial center; and the rolling-cutter cutting elements and the fixed cutting elements combine to define a cutting profile that extends from the axial center to a radially outermost perimeter with respect to the axis, the fixed cutting elements forming an entirety of the cutting profile at the axial center and the radially outermost perimeter, and the rolling-cutter cutting elements overlapping the cutting profile of the fixed cutting elements between the axial center and the radially outermost perimeter.

7. A hybrid drill bit according to claim 6, wherein the rolling-cutter cutting elements cut at a nose and a shoulder portion of the cutting profile.

8. A hybrid drill bit according to claim 6, wherein the rolling-cutter cutting elements and the fixed cutting elements combine to define a cutting face at an axial end of the hybrid drill bit, and at least one of each of the rolling-cutter cutting elements and the fixed cutting elements extend in the axial direction at the cutting face at a substantially equal dimension.

9. A hybrid drill bit according to claim 6, wherein said at least one of the fixed cutting elements is within approximately 0.040 inches of the axial center.

10. A method of subterranean drilling, comprising:

rotating a drill bit against a formation under applied weight on bit;

drilling a central cone region and a gage region of a borehole using only fixed cutting elements; and drilling another portion of the borehole extending radially between the cone region and the gage portion using both fixed and movable cutting elements, wherein the drill bit is a drill bit of one of claim 1 or 6.

11. A hybrid drill bit, comprising:

a bit body having an axis, an axial center, at least one arm extending downwardly in an axial direction, and at least one fixed blade extending downwardly in the axial direction;

at least one rolling cutter mounted to a respective arm, each of the rolling cutters being truncated in length and positioned such that the distal ends of the rolling cutters are radially spaced apart from the axial center by a minimal radial distance;

a plurality of rolling-cutter cutting elements on each rolling cutter and radially spaced apart from the axial center by a minimal radial distance;

a plurality of fixed cutting elements mounted to the fixed blades and at least one of the fixed cutting elements is located near an axial center of the bit body and adapted to cut formation at the axial center;

the rolling-cutter cutting elements and the fixed cutting elements combine to define a cutting profile that extends from the axial center to a radially outermost perimeter with respect to the axis, the fixed cutting elements forming an entirety of the cutting profile at the axial center and the radially outermost perimeter, and the rolling-cutter cutting elements overlapping the cutting profile of the fixed cutting elements between the axial center and the radially outermost perimeter; and the rolling-cutter cutting elements cut at a nose and a shoulder portion of the cutting profile, wherein the nose is located radially outward of the axial center and the shoulder is located radially inward of the radially outermost perimeter.

12. A hybrid drill bit according to claim 11, wherein the rolling-cutter cutting elements and the fixed cutting elements combine to define a cutting face at an axial end of the hybrid drill bit, and at least one of each of the rolling-cutter cutting elements and the fixed cutting elements extend in the axial direction at the cutting face at a substantially equal dimension.

13. A hybrid drill bit according to claim 11, wherein said at least one of the fixed cutting elements is within approximately 0.040 inches of the axial center.

14. An earth-boring bit of the hybrid variety comprising:

a bit body having an axial center and a radially outermost gage surface;

at least one fixed blade depending axially downwardly from the bit body;

at least one rolling cutter mounted for rotation on the bit body, the at least one rolling cutter being truncated in length such that the distal end of the rolling cutter is radially spaced apart from the axial center by a minimal radial distance;

at least one rolling-cutter cutting element arranged on the rolling cutter, the rolling-cutter cutting element being radially spaced from the axial center of the bit body by a minimal radial distance; and a plurality of fixed-blade cutting elements arranged in a row on a leading edge of the fixed blade, the row of fixed-blade cutting elements extending from a radially outermost gage region of the fixed blade to a cone region of the blade proximal the axial center, wherein scraping action of the fixed-blade cutting elements disintegrates formation in the cone and gage regions and crushing action of the rolling-cutter cutting element combines with scraping action of the fixed-blade cutting elements intermediate the cone and gage regions, wherein the combination of the rolling-cutter cutting elements and the fixed cutting elements define a cutting profile that extends from the axial center to a radially outermost perimeter with respect to the axis.

15. The earth-boring bit according to claim 14, wherein the at least one rolling-cutter cutting element comprises a plurality of tungsten carbide inserts arranged in circumferential rows on each rolling cutter.

16. The earth-boring bit according to claim 14, wherein at least a portion of one of the fixed-blade cutting elements is located within 0.040 inches of the axial center of the bit body and is adapted to cut formation at the axial center.

17. The earth-boring bit according to claim 14, wherein the fixed-blade cutting elements are at least partially formed of polycrystalline diamond.

18. The earth-boring bit according to claim 14, wherein the rolling-cutter cutting elements and the fixed cutting elements combine to define a cutting profile that extends from the axial center to a radially outermost perimeter with respect to the axis, the fixed cutting elements forming an entirety of the cutting profile at the axial center and the radially outermost perimeter, and the rolling-cutter cutting elements overlapping the cutting profile of the fixed cutting elements between the axial center and the radially outermost perimeter.

19. An earth-boring bit of the hybrid variety comprising:

a bit body having an axial center and a radially outermost gage;

at least one fixed blade depending axially downwardly from the bit body;

at least one bit leg depending axially downwardly from the bit body;

at least one rolling cutter mounted for rotation on the bit leg, the at least one rolling cutter being truncated in length such that the distal end of the at least one rolling cutter is radially spaced apart from the axial center of the drill bit by a minimal radial distance;

a plurality of rolling-cutter cutting elements arranged on the rolling cutter, the rolling-cutter cutting elements being radially spaced from the axial center and the gage of the bit body by a minimum radial distance; and a plurality of fixed-blade cutting elements arranged in a row on a leading edge of the fixed blade, the row of fixed-blade cutting elements extending from the gage region of the bit body to a cone region proximal the axial center of the blade, wherein the rolling-cutter cutting elements and the fixed cutting elements combine to define a cutting profile that extends from the axial center to a radially outermost perimeter with respect to the axis.

20. The earth-boring bit according to claim 19, wherein scraping action of the fixed-blade cutting elements disintegrates formation in the cone and gage regions and crushing action of the rolling-cutter cutting elements combines with scraping action of the fixed-blade cutting elements intermediate the cone and gage regions.

21. The earth-boring bit according to claim 19, wherein at least a portion of one of the fixed cutting elements is located within 0.040 inches of the axial center of the bit body and is adapted to cut formation at the axial center.

22. The earth-boring bit according to claim 19, wherein the fixed-blade cutting elements are at least partially formed of polycrystalline diamond.

23. The earth-boring bit according to claim 19, wherein the at least one rolling-cutter cutting element comprises a plurality of tungsten carbide inserts arranged in circumferential rows on each rolling cutter.

24. An earth-boring bit, comprising:

a bit body having a central axis;

a cutting profile extending axially downward from the bit body, the cutting profile including a cone region, a nose region, a shoulder region and a gage region;

a plurality of fixed cutting elements on the cutting profile and extending from the cone region proximate a central axis of the bit to the gage region thereof; and a plurality of inserts on the cutting profile and carried by at least one rolling cutter, the plurality of inserts on the profile being located solely in the nose region and the shoulder region, wherein the cutting profile is defined by inserts on the at least one rolling cutter cutting and the fixed cutting elements in combination, and wherein the at least one rolling cutter is truncated in length such that the distal end of the at least one rolling cutter is radially spaced apart from the axial center by a minimal radial distance.

25. The earth-boring bit according to claim 24 further comprising:

at least one fixed blade extending axially downwardly from the bit body, the fixed cutting elements being arranged on a rotationally leading edge of the fixed blade;

at least one bit leg extending axially downwardly from the bit body, the rolling cutter being mounted for rotation on the bit leg.

26. The earth-boring bit according to claim 25, wherein at least a portion of one of the fixed-blade cutting elements is located within 0.040 inches of the axial center of the bit body and is adapted to cut formation at the axial center.

27. An earth-boring bit comprising:

a bit body having a central axis and at least one fixed blade extending axially from the bit body, the fixed blade having a radially outermost gage surface;

a plurality of fixed-blade cutting elements extending from the gage surface to substantially the central axis of the bit body, the fixed-blade cutting elements being arranged to remove formation at a center and sidewall of a borehole during drilling operation; and at least one rolling cutter mounted for rotation on the bit body, the rolling cutter being truncated in length such that the distal ends of the rolling cutters are radially spaced apart from the axial center by a minimal radial distance, and, the rolling cutter including a plurality of rolling-cutter cutting elements arranged on the cutter to remove formation between the center and the sidewall of the borehole during drilling operation and radially spaced apart from the axial center by a minimal radial distance, wherein the rolling-cutter cutting elements and the fixed cutting elements combine to define a cutting profile that extends from the axial center to a radially outermost perimeter with respect to the axis.

28. An earth-boring bit comprising:

a bit body having a central axis and at least one fixed blade extending axially from the bit body, the fixed blade having a radially outermost gage surface;

a plurality of fixed-blade cutting elements extending from the gage surface to substantially the central axis of the bit body, the fixed-blade cutting elements being arranged to remove formation at a center and sidewall of a borehole during drilling operation; and at least one rolling cutter mounted for rotation on the bit body, the rolling cutter including a plurality of rolling-cutter cutting elements arranged on the cutter to be substantially congruent with fixed-blade cutting elements in at least an axially distal-most nose region to remove formation between the center and the sidewall of the borehole during drilling operation, the at least one rolling cutter being truncated in length such that the distal end of the rolling cutter is radially spaced apart from the axial center by a minimal radial distance, wherein at least a portion of one of the fixed-blade cutting elements is located within 0.040 inches of the axial center of the bit body and is adapted to cut formation at the axial center.

* * * * *